United States Patent [19]

Stahlecker et al.

[11] 4,098,065

[45] Jul. 4, 1978

[54] FEEDING AND OPENING APPARATUS FOR A OPEN-END SPINNING MACHINE

[76] Inventors: Fritz Stahlecker, Josef-Neidhart-Str. 18, 7341 Bad Uberkingen; Hans Stahlecker, Haldenstrasse 20, 7334 Suessen, both of Germany

[21] Appl. No.: 691,716

[22] Filed: Jun. 1, 1976

[30] Foreign Application Priority Data

May 30, 1975 [DE] Fed. Rep. of Germany ..... 2524093

[51] Int. Cl.[2] ..... D01H 1/12

[52] U.S. Cl. ..... 57/58.95; 57/56

[58] Field of Search ..... 57/58.89–58.95, 57/56

[56] References Cited

U.S. PATENT DOCUMENTS

| | | | |
|---|---|---|---|
| 3,335,558 | 8/1967 | Doudlebsky et al. | 57/58.95 |
| 3,756,007 | 9/1973 | Bartling | 57/58.95X |
| 3,884,028 | 5/1975 | Stableeker | 57/56 |
| 3,938,310 | 2/1976 | Didek et al. | 57/58.91 |

*Primary Examiner*—Richard C. Queisser
*Assistant Examiner*—Charles Gorenstein
*Attorney, Agent, or Firm*—Craig & Antonelli

[57] ABSTRACT

A spinning machine arrangement is provided having fiber feeding and opening apparatus arranged upstream of the spinning turbine with respect to a supply of fibers to be spun. This apparatus includes a feeder roll and an opening roll arranged serially in the travel path of the fiber stream, said rolls being housed in a housing having one side formed by a flat baseplate. Individual separate guide parts are detachably attached to this baseplate for guiding the flow of fibers and air through the feeder roll and opening roll. These guide parts are constructed of different materials and machined to different tolerances in dependence upon the specific loads and requirements experienced in use due to the configuration and operation of the apparatus. A cover plate is disposed parallel to and in facing relationship to the baseplate, with the opening and feeder rolls, as well as at least a portion of the guide parts disposed therebetween. In preferred embodiments, the axle for the opening roll also operates as a pivot axis for the baseplate, with the opening roll being bearingly supported in the base plate. In this manner, pivotal movements of the baseplate effect engagement and disengagement of the opening roll with driving means thereof. At least some of the guide parts are attached to the baseplate to be adjustable in the radial direction with respect to the opening roll axis, so as to accommodate variable exact positioning thereof.

39 Claims, 9 Drawing Figures

FEEDING AND OPENING APPARATUS FOR A OPEN-END SPINNING MACHINE

BACKGROUND AND SUMMARY OF THE INVENTION

The present invention relates to fiber feeding and opening (separating) apparatus for a spinning machine, especially for an open-end spinning machine. More particularly, the invention involves fiber feeding and opening apparatus for a spinning machine including an opening roll for opening a supply of fibers fed thereto, a housing for housing the opening roll, and guide members for guiding the flow of fibers and air in the area adjacent the opening roll.

Previously contemplated feeder and separating devices for open-end spinning machines normally included a number of guide structures for guiding the fiber band or stream to be separated, for guiding the separated fibers, for guiding the airstream through the device, and for aiding in removing impurities from the area of the separated fibers. In part, these guide structures serve as fiber guide surfaces, and in part they also serve as air guides. Depending upon their disposition in the device and their function, these guide structures are variably loaded during use and are, therefore exposed to variable wear inducing heat and friction forces and the like. In other words, the smoothness of the guide surfaces, as well as the velocity and amount of friction engagement of the fibers against the guide surfaces is different for different positions along the travel path through the feeding and opening device. The guide structures in certain areas along the travel path of the fibers required stringent surface finishing tolerances so as not to adversely affect the operation of the device. In other areas of the device, the guide structures do not require such stringent surface finishing tolerances due to the nature of the flow of the fibers and airstream therealong. German Unexamined Published Application (DT-OS No. 2,029,878) discloses a machine with a spinning turbine arranged in a one-part housing which also accumulated feeding and opening rolls. In this construction, a cover was provided on this one-part housing, which cover enclosed all of the mentioned parts. This cover contained a fiber feeder canal extending from the opening roll or separator drum to the spinning turbine, as well as a thread-removing canal. All other guide structures in this device which delimited the travel path of the fibers through the feeding and opening device were formed together with the one-part housing. Since the maximally stressed guide surfaces determine the quality of the materials from which the housing must be made in this device, the manufacture of same required a very high expenditure.

German Unexamined Published Application (DT-OS) No. 2,161,619 discloses a construction wherein the feeder roll and opening roll, as well as the spinning turbine are arranged stationary. They are covered with a common cover which is provided with an insert which forms a part of the fiber feeder canal and the thread removal canal. Also with this construction, most of the guide structures are formed together with the housing surrounding the feeder and opening rolls so that the manufacture of this housing is relatively expensive, due to the requirement that the housing be constructed of material satisfying the most stringent demands on any of these guide structures.

In a further previously contemplated construction as depicted in German Unexamined Published Application (DT-OS) No. 2,012,278, the feeding and opening device is placed in a common housing which is swingable from a stationary housing containing the spinning turbine. The housing of this construction also has a complicated shape requiring a relatively high manufacturing cost.

A further construction is shown in German Auslegeschrift (DT-AS) No. 1,914,831, in which the housing for the feeder and opening device is split for reasons of manufacture and assembly. In this construction, each of the housing parts has a relatively complicated shape and includes variably stressed guide structures, such that also with this construction, the above-mentioned disadvantages exist, namely the necessity to form substantial parts of the housing with expensive quality materials required by the guide surfaces in certain areas, even though the demands on many portions of the housing would not necessitate such high quality material, and/or machining and manufacturing techniques.

Finally, it is also known from U.S. Pat. No. 3,785,138 to provide exchangeable inserts which are exposed to especially heavy wear, for example, the fiber supply canal arranged between the opening roll and the spinning turbine. Such inserts require an accurate fitting into the remaining parts of the spinning machine so that the manufacturing expense of the very complicated housing is increased rather than decreased by such constructions.

The present invention is directed to the task of creating a housing for a feeder and opening device which requires only a small cost to manufacture and, at the same time, is capable of best satisfying the most varible demands regarding wear, friction values, air guidance, and the like.

The present invention contemplates overcoming the above-mentioned drawbacks and disadvantages of the prior art arrangements by providing that the housing for the feeding and opening apparatus or device includes a baseplate to which are attached a plurality of separate guide parts for guiding the fiber stream, as well as the airstream, as they travel through the device.

The present invention utilizes the knowledge that the structure for defining the fiber stream path between the feed roll and the opening roll are not subjected to severe and basically variable loadings. The high loading of the guide surfaces in the feeding and opening device occurs in general only on the portions of the guide structures located in the circumferential direction of the feeder and opening rolls, consequently only these variable heavy demands for the guide surfaces must be fulfilled in constructing the guide structures. Inasmuch as in accordance with the present invention, these guide means located in the circumferential direction of the rolls are produced independently and separately from the other guide members, they are advantageously manufactured to meet the maximum requirements expected, without thereby increasing the total expense of the construction. In other words, the guide means in the circumferential area of the feeder and roll are formed of material and machined to tolerances so that they can withstand the expected high loadings, while the other guide members can be manufactured from cheaper materials with cheaper manufacturing techniques in view of the lesser expected in-use requirements. Further, since the individual guide members are machined individually and are therefore correspondingly lighter and easier to handle, the same can be machined more accurately than would be the case if they were formed together with other guide structures and/or the housing structure itself. Furthermore, with the arrangement of the present invention, it is possible to exchange one part after a certain period of operation, while retaining the remaining portions of the housing and guide surface members.

According to an especially preferred advantageous embodiment of the invention, a single baseplate is provided to form one side of the housing for the opening and feeder rolls, to which baseplate the separate guide members are detachably attached. Starting with only one baseplate, large variation possibilities result with respect to adaptation to various spinning techniques inasmuch as dissimilar spin-technical arrangements can be utilized for the same baseplate. For example, for exclusive processing of synthetic fiber material with opening devices, yarn soiling and impurities may be substantially avoided, consequently guide means for collecting impurities can be removed and replaced with a filler piece or the like.

In preferred embodiments of the invention, the baseplate is advantageously utilized to support axles attached to the feeder and opening rolls. In particularly preferred embodiments, the bearing for rotatably supporting the opening roll is supported in an aperture in the baseplate, which aperture is spaced from a further aperture which houses a bearing sleeve surrounding the axle for the feeder roll, which bearing sleeve further accommodates pivotal movement of the baseplate between a first position with the opening roll in driving contact with its drive means and a second position with said opening roll out of driving contact with the opening roll drive means. With this construction, minimal expense is involved in maintaining an exact distance between the feeder roll and the opening roll, since the respective apertures in the baseplate effectively fixedly determine this distance. This just-mentioned construction is particularly suitable for constructions having the feeder rolls arranged in relatively fixed stationary positions, since this construction accommodates utilization of the single baseplate to not only hold the feeder roll in a fixed position, but also to accommodate pivotal movement of the housing by a sufficient distance to accommodate engagement and disengagement of the drive for the opening roll.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
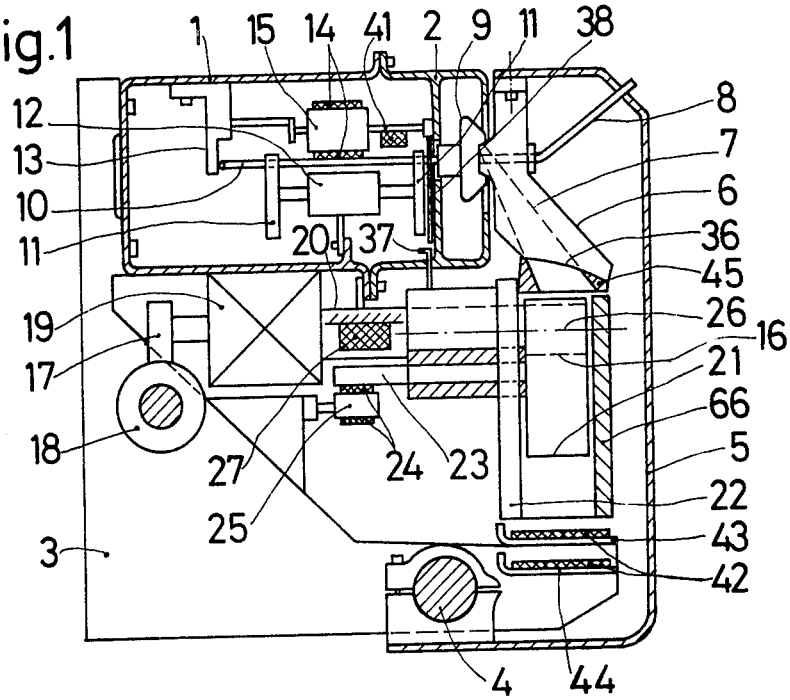
FIG. 1 is a vertical sectional view through an open-end spinning machine with feeding and opening apparatus constructed in accordance with a preferred embodiment of the present invention.

Throughout the following description, similar reference numerals are used throughout the various views to depict similar structures.

Referring to FIGS. 1 to 4, a spinning unit of a spinning machine is depicted which has a two part spinning apparatus housing 1, 2 forming a continuous canal in the machine longitudinal direction. The spinning apparatus housing houses a spinning turbine 9, the shaft 10 of which is supported in a key cleft by respective support rollers 11. The support rollers 11 are supported at the housing part 1 through bearing holders 12. Shaft 10 of the spinning turbine 9 is driven directly through a belt 14 which is loaded with the help of pressure rollers 15 in the direction towards the shaft. Both strands of belt 14 are guided on pressure rollers 15.

In order to provide the spinning turbine 9 of the open-end spinning machine with separated fibers, a fiber band or stream is fed in through an inlet funnel 33. The fiber band is pulled in by a feeder roll 16 which cooperates together with a feeder table 31. Feeder roll 16 and feeder table 31 present the fiber stream to an essentially fast rotating opening or separator roll 21. The separated, single fibers, are fed to the spinning turbine 9 through a fiber supply canal 7 with support from an airstream produced through a vacuum in the area of the spinning turbine 9. In the spinning turbine 9, a thread is spun which is removed via thread removal canal 8.

The feeder roll 16 is supported on a carrier 20, not shown in detail, which carrier is arranged below the spinning apparatus housing 1, 2. The device for the feeder roll 16 is accomplished by a longitudinal shaft passing through in the direction of the machine from where a drive to the feeder drum 16 is taken through spiral gears 17 and 18. Between the feeder drum 16 and spiral gear 17, an electromagnetic clutch 19 is arranged which is controlled by a thread-watchman, not shown, arranged at the exit of the thread discharge canal 8 in such a manner that with a thread break, the fiber feed is interrupted.

A separation of impurities from the fiber being processed is accomplished in the area of the opening roll 21, where the impurities fall onto a conveyor 42 which passes in the longitudinal direction of the machine and which is guided with the help of guide elements 43, 44.

The opening roll 21 is provided with a whorl 23 which is driven by a belt 24 passing through the machine in the longitudinal direction. Both strands of belt 24 are guided by respective rollers 25. For interruption of the drive, the opening roll 21 together with its whorl 23 may be swung away from the belt 24, whereby the whorl 23 rests against a brake lining 27 arranged on the support 20. The swinging motion of the opening roll 21 is limited by a stop 28 onto which an adjusting screw 29 rests when swinging together with the opening roll. Furthermore, the swinging motion is transferred through a trigger 37 on a plunger 38 which actuates a brake mechanism with which the spinning turbine 9 is stopped. For this purpose, the plunger 38 is connected to a lever 39 which is pivotal about axis 40 and which is provided with a brake lining 41 at its free end arranged opposite the turbine shaft 10. The feeder and opening device, consisting essentially of feeder roll 16 and opening roll 21, is contained in a housing 57 which houses all essential parts. This housing 57 is closed towards the outside (in the right-hand side as viewed in FIG. 1) by a cover 5 which is swingable about a longitudinal axis 4 passing through in the longitudinal direction of the machine below the spinning unit. This cover 5 carries an insert 6 containing a portion of a fiber canal 7 leading from housing 57 to the spinning turbine 9 and the fiber canal 8. This insert 6 is adjustably fastened at cover 5 and is alignable in relation to the spinning turbine 9.

Housing 57 of the feeder and opening device consists of a baseplate 22 which is arranged, with a flat planar surface thereof, extending perpendicular to the axes of the opening roll 21 and the feeder roll 16.

Individual guide members, assigned to the feeder roll 16 and the opening roll 21, which serve for the guidance of the fiber stream and the separated fibers as well as for the guidance of the air, are constructed of structural elements independent from each other and are fastened at this baseplate 22. A feeder table 31 is swingably arranged at this baseplate 22 for movement about an axis 30. This feeder table 31 also carries the inlet funnel 33. In other preferred embodiments, the feeder table 31 and inlet funnel 33 are constructed in one piece and detachably attached to the baseplate 22. The feeder table 31 is biased by means of a compression spring 32 in the direction toward the feeder roll 16. This spring 32 is supported on guide member 46, which guide member 46 also forms a downwardly directed extracting opening for impurities, which faces the conveyor band 42. This guide member 46 extends up to adjacent the circumference of the opening roll 21.

A further guide member 45 is connected to baseplate 22 and is configured and disposed partially surrounding the circumference of the opening roll 21. This guide member 45 also forms a start portion of fiber feeder canal 7. The area of the feeder roll 16 facing away from the feeder table 31 and the opening roll 21 is closed by a covering part 47 in order to prevent improper entry of air.

The individual parts 45, 46 and 47 are fastened to the baseplate 22 with screws. At least the area of the opening 21 is covered up in the direction facing away from baseplate 22 with the help of a cover plate 66. The construction of the housing 57 makes it possible to construct the individual parts such that they will be entirely adequate for their expected in-use loadings and demands, without making it required that the entire housing or substantial portions of the housing be constructed from materials as required for the areas of higher stress. The individual parts have a relatively simple shape so that the finishing of the guide surfaces thereon is correspondingly simple since these are easily accessible for machine tools.

Figure 2:
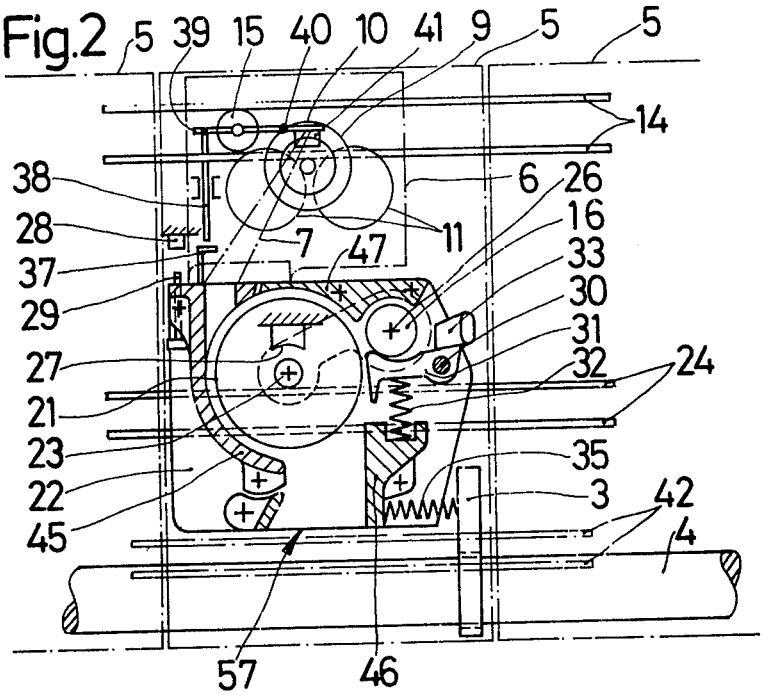
FIG. 2 is a partially cut-away front view of the spinning machine of FIG. 1.
Figure 3:
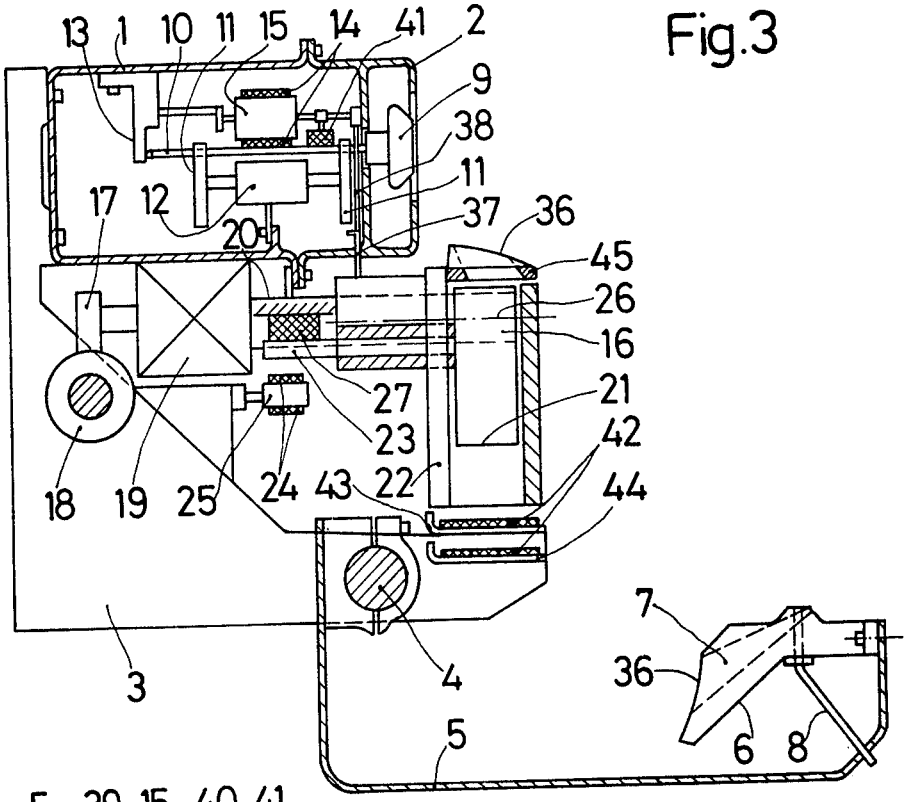
FIG. 3 is a vertical cross-sectional view similar to FIG. 1, however showing the spinning machine in an opened non-operating position.
Figure 4:
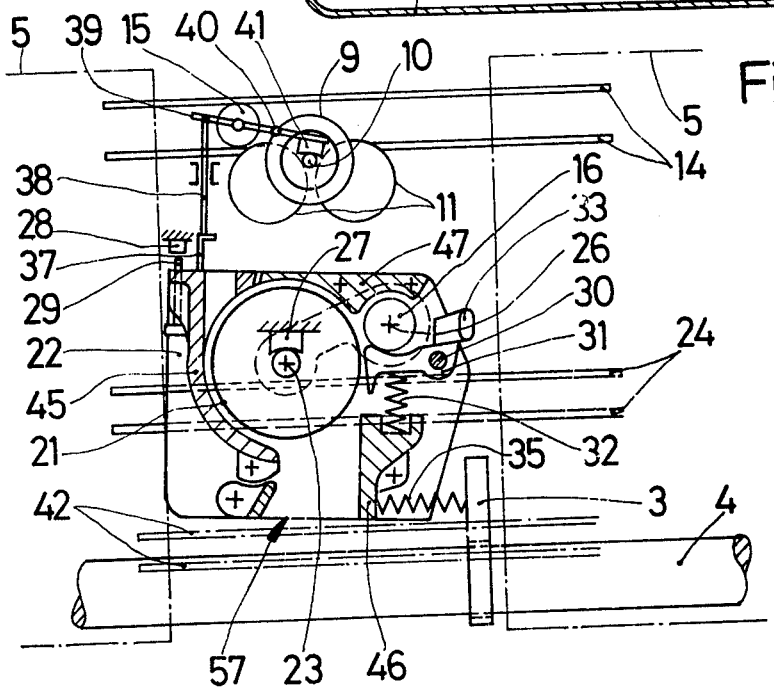
FIG. 4 is a view similar to FIG. 2, but showing the machine in the opened condition of FIG. 3.
Figure 5:
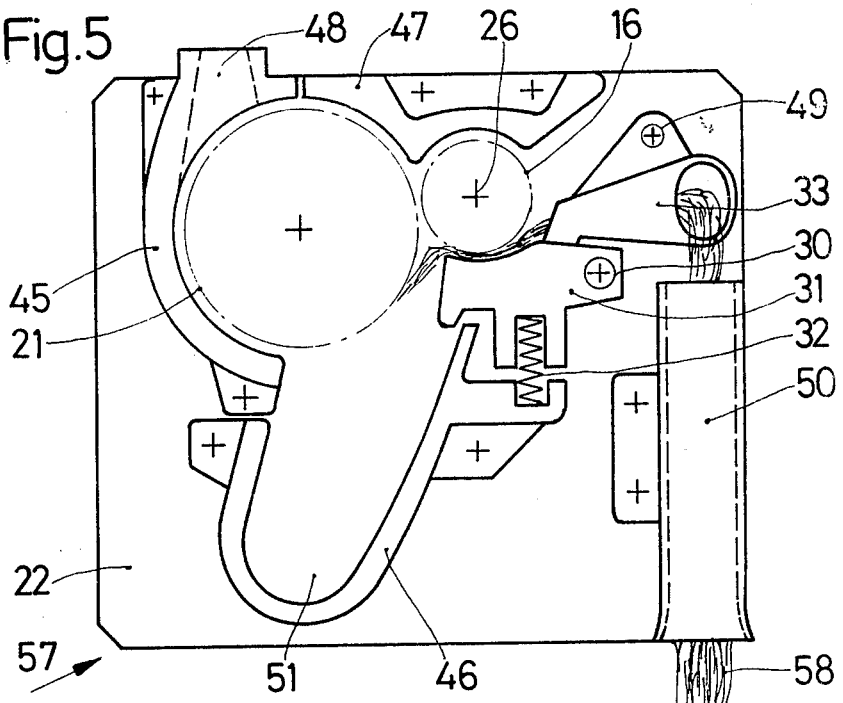
FIG. 5 is a plan view of a baseplate, with attached fiber and air guide structures constructed in accordance with the present invention.

In the embodiment according to FIGS. 1 to 4, the baseplate 22 is provided with a bore 21A into which a bearing housing 52 (see FIGS. 7 and 8) of the opening roll 21 is inserted. Accordingly, the bearing housing 52 for the opening roll 21 is supported and arranged in the baseplate 22 of the housing 57. The baseplate 22 is further provided with a bore **16*a* with which it is held by means of a bearing on the shaft 26 of the feeder roll 16. The entire housing 57, together with the opening roll 21 is, therefore, pivotal about shaft 26 of the feeder roll 16. This pivoting capability of the housing 57 serves to accommodate lifting off of the whorl 23 of the opening roll 21 from the belt 24 and to join the same to the brake lining 27. Housing 57 is secured in the operating position by the covering 5, respectively, the insert 6 as shown in FIGS. 1 and 2. For this purpose, the insert 6 and the guide element 45 of housing 57 are provided with interengageable sliding surfaces 36, corresponding one to the other, which, during closing of the covering 5 support themselves one with the other. Housing 57 is biased by a pressure spring 35 (which abuts against guide surface member 46 as shown in FIGS. 2 and 4), which spring 35 supports itself on a disk 3 arranged on the longitudinal axle 4 and which releases the swinging movement of housing 57 because of the relative orientation of the parts as shown (compare FIGS. 1 and 2 where the machine is in the closed operating position with FIGS. 3 and 4 with the machine in the opened position). That is, the axis of shaft 26 of the feeder 16 lies, relative to the pivot axis 4 of the covering 5, in approximately the same distance as the sliding surfaces 36 so that the lateral relative movements between the two sliding surfaces 36 are relatively small. In this construction, spring 35 serves therefor, that between the two parts of the fiber feeder canal 7, that is between that part of the guide element 45 and the part of insert 7**, no additional sealing means are required.

In the construction depicted in FIGS. 5 to 8, the housing 57 of the feeder and opening device includes baseplate 22, plane on both sides, which plate 22 is arranged parallel to the inner face of opening roll 21 and feeder roll 16 (see also FIGS. 1 to 4 for orientation of baseplate 22 with respect to the feeder and opening rolls). The baseplate 22 is pivotally supported by a bearing sleeve 53, inserted into bore **16*a*, on the shaft 26 of the feeder roll 16. The support of the baseplate 22 in the circumferential direction is accomplished through an insert connected to the covering 5 according to the above-described arrangement of FIGS. 1 to 4 and through a compression spring 35 as is shown, for example, in FIGS. 2 and 4. The baseplate 22 and therewith the entire housing 57 are hung onto the bearing sleeve 53 by means of a tension spring 56 which pulls the same toward the ring shoulder 58 of the bearing sleeve 53. Upon loosening of the tension spring 56, the baseplate 22, respectively, the entire housing 57 of the feeder and opening device, together with the opening roll 21, may be pulled off towards the front over the feeder roll 16**.

The individual guide elements are removably fastened to the baseplate 22, for example, by screws. An intake piece 50 is arranged on baseplate 22, which piece 50 is to assure an orderly feed of the fiber band or stream 58. Feed funnel 33, arranged immediately downstream of intake piece 50, is connected in a pivotal manner at bolt 49. The feed funnel 43 guides the fiber band 58 into the area between the feeder roll 16 and the feeder table 31, which feeder table 31 is pivotally fastened about a bolt 30 on the baseplate 22. The feeder table 31 is biased in the direction against the feeder roll 16 by mans of a compression spring 32, which spring 32 supports itself at a shoulder of guide part 36. Guide part 36 is also fastened at the baseplate 22 and forms a dirt collecting chamber 51 which exhibits a large surface opening to the circumference of the opening roll 21.

The subsequent (as seen in the clockwise direction looking at FIG. 5) area of the circumference of the opening roll 21 is bounded by a further removably fastened guide member 45 which includes a canal attachment 48. Canal attachment 48 commences approximately tangentially at the opening roll 21 and steadily converges in the direction away from the open roll 21 and is connected with a further insert (not shown), with a further canal portion extending into the inside of the spinning rotor. The remaining circumferential area of the feeder roll 16 and the opening roll 21 is bounded by a cover part 47 which is also detachably fastened at the baseplate 22. This cover part 47 serves to prevent improper entry of air.

Figure 6:
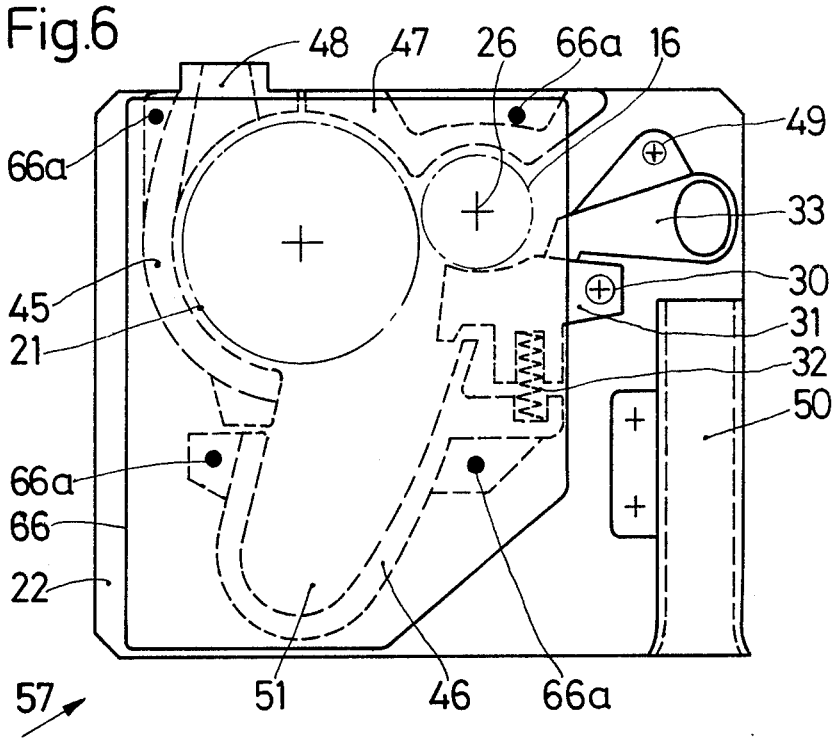
FIG. 6 is a view similar to FIG. 5, however showing a cover plate attached to the baseplate, with the guide and other structures disposed between the base and cover plates depicted by dash lines.

As best shown in FIG. 6 (and as also depicted in FIGS. 1 and 3), a cover plate 66 is arranged in facing relationship to the baseplate 22 and covers the area of the opening roll 21 and the feeder roll 16. This cover plate 66 is arranged parallel to the baseplate 22 and rests on parts 45, 46 and 47. This cover plate is detachably fastenable to one of the baseplate 22 or these parts 45, 46 and 47. It is further contemplated by this invention to provide, for example, only plug connections at the baseplate 22 for the parts 45, 46 and 47 and to fix these in position with the help of the cover plate 66 which, for example, is fastened directly to the baseplate by fastening screws 66*a*.

The individual guide members, which are fastened to the baseplate 22, are preferably selected of various metals, depending in each case upon the expected loading and shape and surface configuration required. The intake piece 50 which, in many of the shown embodiments, has a relatively complicated design, is preferably formed of synthetic materials and such a complicated form may be put into practice in a relatively simple manner with such material. Since only relatively small wear demands are required for the guide part 46 which defines the dirt collecting chamber 51, the same is preferably formed of aluminum or synthetic material in order to minimize the cost thereof. It is further contemplated to form certain of the guide parts as an extruded profile cut into lengths, each length being usable in the given assembly as shown and described herein.

The highest demands insofar as wear and friction surface characteristics are required of the guide part 45 which includes the canal portion 48. Accordingly, the present invention contemplates selecting a wear resistant material and the formation of maximally friction-free guide surfaces for the guide member 45. Preferably this member 45 is formed of precision casting of a hard chromium covered aluminum part. Further, in practice, it is proven advantageous to provide an austenal steel casing for the guide member 45, which is hardened and polished electrolytically. This hardening may, also according to the invention, be accomplished through nitrating. According to the invention, the fiber guide surfaces of the guide member 45 form a homogeneous unit uninterrupted by separating lines.

Figure 7:
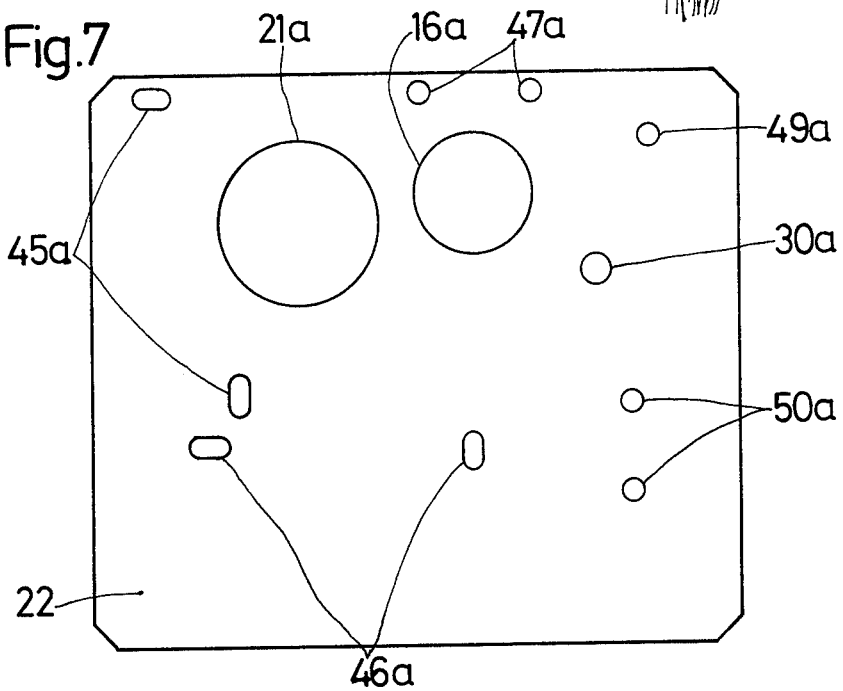
FIG. 7 is a plan view of the baseplate of FIG. 5, with the guide structures and feeder and opening rolls removed.
Figure 8:
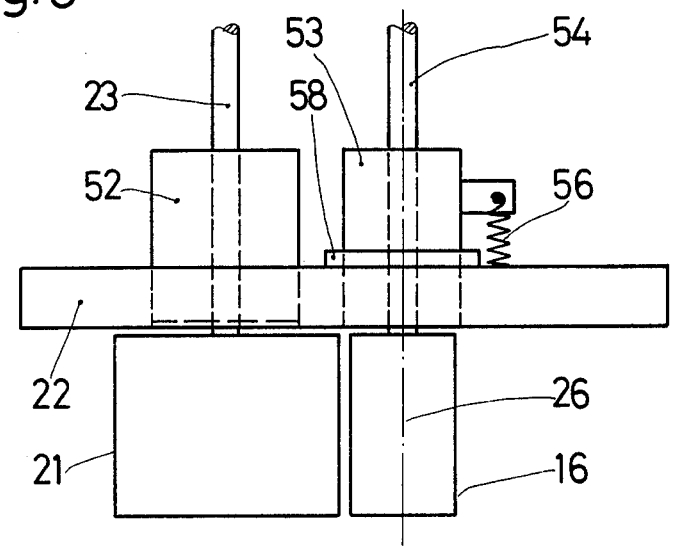
FIG. 8 is a schematic partial top view illustrating the relative position of the baseplate of FIGS. 5 to 7 with respect to the feeder and opening rolls.

As best shown in FIG. 7, the baseplate 22 is provided with several of axis-parallel bores. Bore 16A serves for accommodating bearing sleeve 53 with which the entire housing 57 supports itself on the shaft 26 of the feeder roll 16. Bore 21A accommodates the bearing housing 52 of the opening roll 21. For securing the intake piece 50, bores 50*a* are provided, which bores may be constructed as pass-through bores or as threaded bores. Bores 47*a* which serve for the fastening of the cover part 47 may also, according to the invention be constructed as pass-through bores or also as threaded bores. Further bores 30*a* and 49*a* serve for receiving bolts 30, 49 of the feeder table 31 and the feeder funnel 33.

For the fastening of the guide member 46 which defines the dirt-collecting chamber 51, two elongated holes 46*a* are provided, the larger extensions of which proceed at a right angle one to the other. By this configuration of these bores 46*a*, it is possible to line up the guide member 46 within certain limits in relation to the opening roll 21, as well as the adjacent guide members 31 or 45. Two elongated holes 45*a* are also provided for the guide member 45, the longest extension of which also proceed at right angles to each other. With this construction, it is possible to align and adjust the guide member 45 within certain limits in relation to the circumference of the opening roll 21, as well as with respect to the insert bordering portion 48 and containing the further part of the fiber feeder canal.

Figure 9:
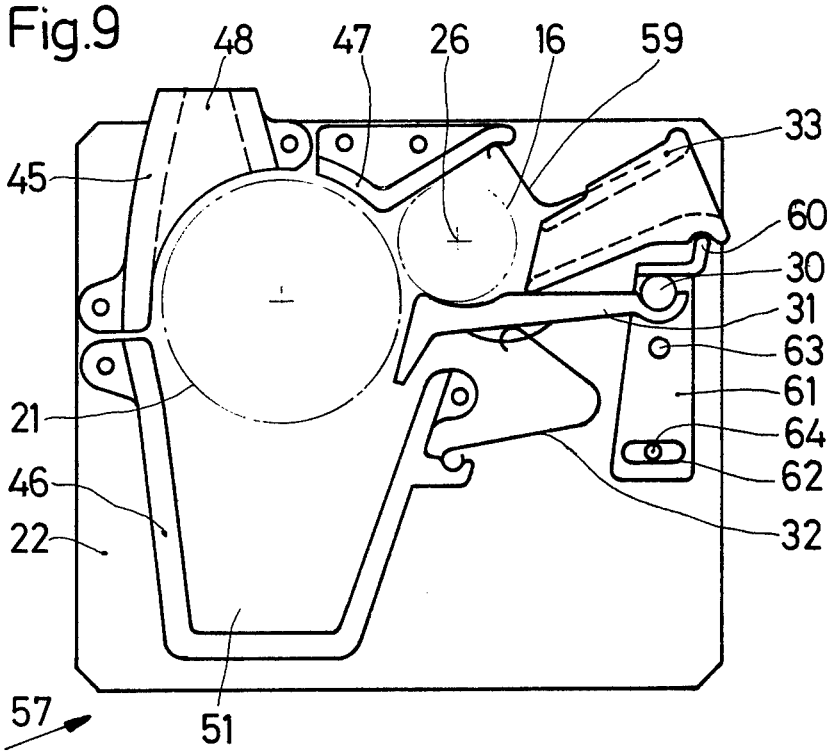
FIG. 9 is a view similar to FIG. 5, however showing a different embodiment of the present invention insofar as construction of the fiber and air guide surfaces are concerned.

Other contemplated embodiments of the present invention include a baseplate 22 permanently attached in position on the spinning machine. FIG. 9 illustrates such a baseplate, which is fixedly attachable to a support frame of the spinning machine in the area of the four corners of the base plate. In utilizing this embodiment, the support frame may then itself be permanently connected with the machine frame or it may be part of a swingable housing which may be swung away from the area of the spinning turbine for opening the spinning machine.

In the embodiment according to FIG. 9, the individual guide members are also arranged removable and easily exchangeable at the baseplate 22. In this embodiment, it is additionally provided that the feeder table 31 and the feeder tunnel 33 are especially simple to exchange. A holer 61 is fastened to the baseplate 22 by means of screws 63 and 64, whereby one of the screws is guided in an elongated hole 62 of holder 61 so that the same may be accurately aligned. Holder 61 is provided with a bolt 30 onto which rests the feeder table 31 with a half-shell shaped recess. The feeder table 31 is pressed against this bolt 30 and the feeder roll 16 by means of a bending spring 32. Spring 32 supports itself at a shoulder at the guide member 46 defining the dirt collecting chamber 51. The holder 61 is additionally provided with a shoulder 60 on which the feeder funnel 33 swingably supports itself by means of a recess, which, with the help of a bending spring 59, which supports itself on the covering part 47, is pressed against the feeder table 31 and the shoulder 60. The remaining parts correspond to the embodiment according to FIGS. 5 to 8 in their construction and function.

Inasmuch as in the embodiment according to FIG. 9, in the area of the baseplate located in the drawing upper right side, no fastening bores or the like are provided, the baseplate 22 can in this area, be recessed in such a way that the area of the feeder roll 16 lies free. In this way, it is possible to provide the housing 57 also for spinning machines, for which the feeder roll is constructed as a continuous supply cylinder in the longitudinal direction of the machine. When the feeder funnel 33 and the feeder table 31 are removed, the housing as a total unit, may be dismantled inclined upwardly and again assembled from there.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Fiber feeding and opening apparatus for a spinning machine comprising:

opening roll means for opening a supply of fibers, housing means for housing said opening roll means, said housing means including baseplate means, guide means for guiding the supply of fibers during its travel adjacent the opening roll means, feeder roll means housed by said housing means, and opening roll bearing means for rotatably supporting said opening roll means, wherein said opening roll bearing means are supported at said baseplate means, and wherein said feeder roll means is supported independently of the housing means at the spinning machine, said baseplate means including an opening for accommodating disposition of said feeder roll means in said housing means.

2. Apparatus according to claim 1, wherein said baseplate is a unitary member which extends perpendicularly to the rotational axis of said opening roll means.

3. Apparatus according to claim 2, wherein said baseplate is a member which is flat on respective opposite sides, wherein said guide parts and said opening roll means are disposed at one side of said baseplate, wherein said guide parts include a first guide part forming an impurity collecting chamber adjacent the opening roll means, a second guide part arranged downstream of said first guide part in the direction of movement of the fiber stream around the opening roll means, said second guide part including very low-friction guide surfaces for accommodating passage of opened fibers from the opening roll means to an inlet of a canal leading to a spinning turbine of the spinning machine, a third guide part forming a circumferential cover for the space intermediate the second guide part and a feeder roll of said device, a feeder funnel, and a feeder table, wherein a spring means supported at said first guide part biases said feeder table toward said opening roll, and wherein aid further spring means supported at said third guide part biases said feeder funnel toward said feeder table.

4. Apparatus according to claim 1, wherein attaching means are provided for detachable and exchangeably attaching each of said guide parts to said baseplate means.

5. Apparatus according to claim 4, wherein said baseplate is a unitary member which extends perpendicularly to the rotational axis of said opening roll means.

6. Apparatus according to claim 1, wherein said guide means includes a feeder funnel detachably attached to the baseplate means at a position upstream of the feeder roll means with respect to the fiber stream movement.

7. Apparatus according to claim 1, wherein said guide means includes an impurity collecting guide part with an enclosure for accumulating impurities, said impurity collecting guide part being detachably attached to the baseplate means.

8. Apparatus according to claim 7, wherein said impurity collecting guide part is disposed adjacent to the opening roll means, and wherein said baseplate is a unitary member which extends perpendicularly to the rotational axis of said opening roll means.

9. Apparatus according to claim 7, wherein said guide means includes an open filber guide part disposed adjacent the opening roll means and detachably attached directly to the baseplate means, said open fiber guide part enclosing part of a fiber-guiding channel leading from said opening roll means to a spinning rotor of the spinning machine.

10. Apparatus according to claim 7, wherein said impurity collecting guide part is adjustably and detachably attached to said baseplate means in such a manner as to accommodate radial adjustment thereof with respect to said opening roll means and with respect to other guide parts.

11. Apparatus according to claim 7, wherein said impurity collecting guide part and said open fiber guide part are constructed of different materials.

12. Apparatus according to claim 11, wherein said open fiber guide part is constructed of one of hard chromium covered aluminum and hardened, electrolytically polished austenal steel, and wherein said impurity collecting guide part is formed of synthetic resinous material.

13. Apparatus according to claim 1, wherein said guide means includes an open fiber guide part disposed adjacent the opening roll means and detachably attached directly to the baseplate means, said open fiber guide part enclosing part of a fiber-guiding channel leading from said opening roll means to a spinning rotor of the spinning machine.

14. Apparatus according to claim 13, wherein said guide means includes a feeder funnel detachably attached to the baseplate means at a position upstream of the feeder roll means with respect to the fiber stream movement.

15. Apparatus according to claim 14, wherein said guide means includes a feeding table associated with the feeder roll means and movably attached to the baseplate means.

16. Apparatus according to claim 15, wherein said guide means includes an impurity collecting guide part with an enclosure for accumulating impurities, said impurity collecting guide part being detachably attached to the baseplate means.

17. Apparatus according to claim 16, wherein said housing means includes a cover disposed in facing relationship to the baseplate means.

18. Apparatus according to claim 17, wherein said cover is configured to cover the periphery of the opening roll means and the feeder roll means so as to form, together with the baseplate means, the lateral boundaries of the travel path for the fiber stream during the travel thereof around the opening roll means.

19. Apparatus according to claim 1, wherein said housing means includes a cover disposed in facing relationship to the baseplate means.

20. Apparatus according to claim 19, wherein said cover is configured to cover the periphery of the opening roll means so as to form, together with the baseplate means, the lateral boundaries of the travel path for the fiber stream during the travel thereof around the opening roll means.

21. Fiber feeding and opening apparatus for a spinning machine comprising:

opening roll means for opening a supply of fibers, housing means for housing said opening roll means, said housing means including baseplate means, guide means for guiding the supply of fibers during its travel adjacent the opening roll means, said guide means including a plurality of separate guide parts supported at said baseplate means, feeder roll means housed by said housing means and opening roll bearing means for rotatably supporting said opening roll means, wherein said opening roll bearing means are supported at said baseplate means, further comprising base pivot means for pivotally supporting said baseplate means for movement between a first position with said opening roll in driving contact with opening roll drive means and a second position with said opening roll out of driving contact with said opening roll drive means, and wherein said feeder roll means is configured and disposed to remain in a relatively fixed position during said movement of said opening roll between its first and second positions.

22. Apparatus according to claim 21, wherein said housing means includes a cover disposed in facing relationship to the baseplate means, and wherein said cover is configured to cover the periphery of the opening roll means and the feeder roll so as to form, together with the baseplate means, the lateral boundaries of the travel path for the fiber stream during the travel thereof around the opening roll means.

23. Apparatus according to claim 22, wherein said cover is detachably attached to said baseplate means.

24. Apparatus according to claim 21, further comprising a spinning unit including a spinning turbine and a spinning unit cover member pivotally movable between an open nonoperating position and a closed operating position, wherein means are provided interconnecting said cover and said baseplate means so as to affect said movement of said baseplate means between its first position forcing said opening roll means in driving contact with said opening roll drive means and its second position with said opening reoll means out of driving contact with said opening roll drive means and into engagement with brake means.

25. Fiber feeding and opening apparatus for a spinning machine comprising:

opening roll means for opening a supply of fibers, housing means for housing said opening roll means, said housing means including baseplate means, guide means for guiding the supply of fibers during its travel adjacent the opening roll means, said guide means including a plurality of separate guide parts supported at said baseplate means, feeder roll means housed by said housing means, and opening roll bearing means for rotatably supporting said opening roll means, wherein said opening roll bearing means are supported at said baseplate means, wherein said feeder roll means includes a feeder roll mounted for rotation with a feeder roll axle, said feeder roll axle extending through said baseplate means at a position spaced from said opening roll bearing means, further comprising base pivot means for pivotally supporting said baseplate means for movement between a first position with said opening roll in driving contact with opening roll drive means and a second position with said opening roll out of driving contact with said opening roll drive means, and wherein said base pivot means has a pivot axis coaxial with said feeder roll axle.

26. Apparatus according to claim 25, wherein the base pivot means includes a bearing sleeve for rotatably supporting said feeder roll axle, and wherein said bearing sleeve is fastened to said baseplate means by a releasable holder.

27. Apparatus according to claim 25, wherein the baseplate means is a single plate mounted on the base pivot means by way of releasable holder.

28. Fiber feeding and opening apparatus for a spinning machine comprising:

opening roll means for opening a supply of fibers, housing means for housing said opening roll means, said housing means including baseplate means, guide means for guiding the supply of fibers during its travel adjacent the opening roll means, said guide means including a plurality of separate guide parts supported at said baseplate means, and wherein an intake channel for guiding a fiber stream into said housing is detachably attached to the baseplate means, wherein a feeder roll means is housed in said housing means upstream of said opening roll means, and wherein a feed funnel is disposed in between said intake channel and said feeder roll means, said intake channel being disposed upstream of and separate from said feed funnel.

29. Apparatus according to claim 28, further comprising:

feeder roll means housed by said housing means, and opening roll bearing means for rotatably supporting said opening roll means, wherein said opening roll bearing means are supported at said baseplate means.

30. Apparatus according to claim 29, wherein said feeder roll means includes a feeder roll mounted for rotation with a feeder roll axle, said feeder roll axle extending through said baseplate means at a position spaced from said opening roll bearing means.

31. Apparatus according to claim 30, further comprising base pivot means for pivotally supporting said baseplate means for movement between a first position with said opening roll in driving contact with opening roll drive means and a second position with said opening roll out of driving contact with said opening roll drive means.

32. Apparatus according to claim 29, wherein said baseplate is a unitary member which extends perpendicularly to the rotational axis of said opening roll means, wherein said feed funnel is detachably attached to the baseplate.

33. Apparatus according to claim 32, wherein said guide means includes a feeding table associated with the feeder roll means and movably attached to the baseplate.

34. Apparatus according to claim 28, wherein said baseplate means is relatively permanently fixed.

35. Apparatus according to claim 28, wherein said baseplate is a unitary member which extends perpendicularly to the rotational axis of said opening roll means.

36. Fiber feeding and opening apparatus for a spinning machine comprising:

opening roll means for opening a supply of fibers, housing means for housing said opening roll means, said housing means including baseplate means, and guide means for guiding the supply of fibers during its travel adjacent the opening roll means, said guide means including a plurality of separate guide parts supported at said baseplate means, further comprising feeder roll means housed by said housing means, wherein said housing means includes a cover disposed in facing relationship to the baseplate means, and wherein said cover is configured to cover the periphery of the opening roll means and the feeder roll so as to form, together with the baseplate means, the lateral boundaries of the travel path for the fiber stream during the travel thereof around the opening roll means, wherein said cover is detachably attached to said baseplate means, and wherein said baseplate is a unitary member which extends perpendicularly to the rotational axis of said opening roll means, wherein said cover is a flat plate extending parallel to said baseplate, said cover and said baseplate being detachably connected to one another such that said cover clamping engages edges of at least some of said guide parts.

37. Apparatus according to claim 36, wherein said guide means includes an open fiber guide part disposed adjacent the opening roll means and attached to the baseplate means, said open fiber guide part enclosing part of a fiber-guiding channel leading from said opening roll means to a spinning roll of the spinning machine.

38. Fiber feeding and opening apparatus for a spinning machine comprising:

opening roll means for opening a supply of fibers, housing means for housing said opening roll means, said housing means including baseplate means, and guide means for guiding the supply of fibers during its travel adjacent the opening roll means, said guide means including a plurality of saparate guide parts supported at said baseplate means, wherein said guide means includes an impurity collecting guide part with an enclosure for accumulating impurities, said impurity collecting guide part being detachably attached to the baseplate means, wherein said guide means includes an open fiber guide part disposed adjacent the opening roll means and attached to the baseplate means, said open fiber guide part enclosing part of a fiber-guiding channel leading from said opening roll means to a spinning rotor of the spinning machine, and wherein both said impurity collecting guide part and said open fiber guide part are adjustably and detachably attached to said baseplate means in such a manner as to accommodate radial adjustments thereof with respect to one another and with respect to said opening roll means.

39. Fiber feeding and opening apparatus for a spinning machine comprising:

opening roll means for opening a supply of fibers, housing means for housing said opening roll means, said housing means including baseplate means, and guide means for guiding the supply of fibers during its travel adjacent the opening roll means, said guide means including a plurality of separate guide parts supported at said baseplate means, wherein said guide means includes an impurity collecting guide part with an enclosure for accumulating impurities, said impurity collecting guide part being detachably attached to the baseplate means, and wherein said guide means includes an open fiber guide part with an enclosure for accumulating impurities, said open fiber guide part being detachably attached to the baseplate means.

* * * * *